US005699606A

United States Patent [19]

McWilliams

[11] Patent Number: 5,699,606

[45] Date of Patent: *Dec. 23, 1997

[54] METHOD OF MANUFACTURING A RADIANT ELECTRIC HEATER

[75] Inventor: Joseph Anthony McWilliams, Droitwich, United Kingdom

[73] Assignee: Ceramaspeed Limited, United Kingdom

[ * ] Notice: The term of this patent shall not extend beyond the expiration date of Pat. No. 5,453,597.

[21] Appl. No.: 557,570

[22] Filed: Nov. 14, 1995

Related U.S. Application Data

[63] Continuation of Ser. No. 409,692, Mar. 24, 1995, abandoned, which is a continuation of Ser. No. 193,565, Feb. 8, 1994, Pat. No. 5,453,597.

[30] Foreign Application Priority Data

Feb. 11, 1993 [GB] United Kingdom ..... 9302689

[51] Int. Cl.[6] ..... H05B 3/00

[52] U.S. Cl. ..... 29/611; 29/846; 29/850

[58] Field of Search ..... 29/611, 846, 848, 29/850; 219/457, 458, 459, 467, 468

[56] References Cited

U.S. PATENT DOCUMENTS

| | | |
|---|---|---|
| 600,057 | 3/1898 | Ball . |
| 1,649,809 | 11/1927 | Campbell . |
| 1,923,644 | 8/1933 | Simpson . |
| 2,570,975 | 10/1951 | Osterheld . |
| 3,984,615 | 10/1976 | Beck . |
| 4,221,672 | 9/1980 | McWilliams . |
| 4,292,504 | 9/1981 | Gebarowski et al. . |
| 4,503,319 | 3/1985 | Moritoki et al. . |
| 4,713,527 | 12/1987 | Kicherer et al. . |
| 4,789,773 | 12/1988 | Mikschl . |
| 4,864,105 | 9/1989 | Morgan et al. . |
| 5,051,561 | 9/1991 | McWilliams et al. . |
| 5,477,605 | 12/1995 | McWilliams et al. ..... 29/611 |

FOREIGN PATENT DOCUMENTS

| | | |
|---|---|---|
| 2740163 | 9/1978 | Germany . |
| 3527413 | 2/1987 | Germany . |
| 1569588 | 6/1980 | United Kingdom . |
| 1580909 | 12/1980 | United Kingdom . |

*Primary Examiner*—P. W. Echols
*Attorney, Agent, or Firm*—Ira S. Dorman

[57] ABSTRACT

An electrical heating element for a radiant electric heater takes the form of an elongate electrically conductive strip for partial embedding edgewise in a base of thermal and electrical insulation material. The strip is composed of an elongate continuous portion and an elongate discontinuous portion integral with the continuous portion. The discontinuous portion is intended for embedding in the base and is provided with a plurality of discontinuities so that in operation of the heater current flow in the discontinuous portion is reduced or eliminated.

18 Claims, 3 Drawing Sheets

METHOD OF MANUFACTURING A RADIANT ELECTRIC HEATER

This is a continuation of application Ser. No. 08/409,692, now abandoned, filed on Mar. 24, 1995, which was in turn a continuation of application Ser. No. 08/193,565 filed on Feb. 8, 1994 now U.S. Pat. No. 5,453,597.

This invention relates to an electrical heating element for a radiant electric heater, more particularly, but not exclusively, for use with a glass-ceramic smooth top cooker. More particularly, the invention relates to an electrical heating element in the form of an elongate strip of electrically conductive material, such as a metal or a metal alloy, for partial embedding edgewise into a base of thermal and electrical insulation material, such as microporous thermal and electrical insulation material. The invention also relates to a radiant electric heater incorporating such an electrical heating element.

BACKGROUND TO THE INVENTION

The term microporous is used herein to identify porous or cellular materials in which the ultimate size of the cells or voids is less than the mean free path of an air molecule at NTP, i.e. of the order of 100 nm or smaller. A material which is microporous in this sense will exhibit very low transfer of heat by air conduction (that is collisions between air molecules). Such microporous materials include aerogel, which is a gel in which the liquid phase has been replaced by a gaseous phase in such a way as to avoid the shrinkage which would occur if the gel were dried directly from a liquid. A substantially identical structure can be obtained by controlled precipitation from solution, the temperature and pH being controlled during precipitation to obtain an open lattice precipitate. Other equivalent open lattice structures include pyrogenic (fumed) and electro-thermal types in which a substantial proportion of the particles have an ultimate particle size less than 100 nm. Any of these particulate materials, based for example on silica, alumina or other metal oxides, may be used to prepare a composition which is microporous as defined above.

The microporous insulation typically comprises a dry particulate microporous material as defined hereinabove mixed with ceramic fibre reinforcement, titanium dioxide opacifier and, for high-temperature use, a small quantity of alumina powder to resist shrinkage. Such microporous insulation material is described in GB-A-1 580 909.

When a heating element in the form of an elongate strip of electrically conductive material is partially embedded edgewise into a base of insulation material, such as microporous thermal and electrical insulation material, to form a radiant heater, during operation of the heater the strip reaches a high temperature required for satisfactory operation of the heater. However, the entire strip comprising exposed and embedded regions operates at a high temperature and it would be advantageous if the embedded portion of the strip could be arranged to attain a lower temperature than the exposed region when the heater is operated.

It is known from GB-A-1 569 588 to provide a heating conductor strip which is slotted alternately from opposite edges and is provided with spaced anchoring tabs which extend from the strip and penetrate an underlying insulating sheet. As acknowledged in GB-A-1 569 588 the slots have the disadvantageous effect of reducing the rigidity of the heating conductor strip in all directions. Moreover, the anchoring tabs are spaced at a distance of several slots from one another. The overall effect of the low rigidity heating conductor and the relatively wide spacing of the anchoring tabs gives rise to undesirable distortion of the heating conductor as a result of the regular cycles of heating and cooling to which the heating conductor is subjected. This in turn can lead to adjacent turns of the heating conductor becoming too close to each other and giving rise to an electrical short circuit or to the heating conductor coming into contact with a temperature sensor which is conventionally provided in radiant heaters for glass-ceramic smooth top cookers.

U.S. Pat. No. 4,292,504 describes an electric resistance heating unit in which the heating element comprises a thin, foil-like strip of expanded metal supported on edge substantially along its entire length on a board of insulating material. The heating element is either cemented or a close fit within a groove formed in the board. Such an expanded metal heating element occupies an undesirable amount of space within the heater and is relatively fragile: it additionally gives rise to the same flow of electric current in the portion of the heating element within the groove as in the exposed portion thereof and the embedded portion of the heating element therefore rises to an undesirably high temperature.

U.S. Pat. No. 600,057 describes an electric heater in which a conductor stamped into one of a number of shapes is attached edgewise to a support by one or more layers of enamel. The conductor is shaped in order to prevent damage to the enamel which is used to attach the conductor to the support. By way of example, the conductor may be provided with a series of lateral projections, which may be of any desired shape, which projections are partially or entirely embedded in the enamel, with the body of the conductor being exposed.

OBJECT OF THE INVENTION

It is an object of the present invention to provide a heating element in the form of an elongate strip of electrically conductive material in which one elongate portion of the strip is able to operate at a lower temperature than another portion thereof. Such a heating element should give rise to a more rapid heating up of the element to radiance.

SUMMARY OF THE INVENTION

According to one aspect of the present invention there is provided an electrical heating element for a radiant electric heater, the element comprising an elongate electrically conductive strip for partial embedding edgewise in a base of thermal and electrical insulation material, the strip being composed of an elongate continuous portion and an elongate discontinuous portion integral with the continuous portion, the discontinuous portion being intended for embedding in the base and being provided with a plurality of discontinuities therein, whereby in operation of the heater current flow in the discontinuous portion is reduced or eliminated.

According to another aspect of the present invention there is provided a radiant electric heater comprising a base of thermal and electrical insulation material and an elongate electrically conductive strip partially embedded edgewise therein, the strip being composed of an elongate continuous portion and an elongate discontinuous portion integral with the continuous portion, the discontinuous portion being at least partially embedded in the base and being provided with a plurality of discontinuities therein, whereby in operation of the heater current flow in the discontinuous portion is reduced or eliminated.

The term "continuous" is used herein in respect of the continuous portion of the strip to denote an elongate portion of the strip which is of substantially uniform dimensions. In contrast, the term "discontinuous" is used herein in respect of the discontinuous portion of the strip to denote a portion of the strip, adjacent to the continuous portion, which is provided with tabs or the like which extend in a direction away from the continuous portion such that the cross-sectional area of material, in a direction substantially perpendicular to the elongate direction of the continuous portion of the strip, is variable in the elongate direction of the strip. Thus, at some points in the elongate direction of the strip the cross-sectional area of material may be substantially reduced as compared with other points, or there may be no material at all.

The discontinuities serve a number of purposes. Firstly, during operation of the element in a heater they reduce or eliminate electric current flow and hence self-heating of the strip along the length of the strip in that region thereof where they are provided and a lower temperature results in the strip in this region, which is embedded in the insulation material, compared with the remaining exposed region of the strip. Secondly, the discontinuities serve to enhance securement of the strip to the insulation material when embedded therein. Thirdly, the discontinuities reduce the mass of the strip and this leads to more rapid heating up to radiance of the exposed region of the strip. Fourthly, the discontinuities can be arranged such that they reduce thermal conduction from the region of the strip which is to be exposed, into that region which is to be embedded.

The discontinuous portion of the strip may be coplanar with the continuous portion thereof.

The discontinuities should ideally be provided as close together as is reasonably possible along the length of the strip. The area of the discontinuities of the discontinuous portion in the plane thereof may be less than the remainder of the area of the discontinuous portion. The discontinuities may be in spaced relationship along the length of the discontinuous portion of the strip.

The discontinuities may comprise slots or slits formed in the discontinuous portion of the strip. The slots or slits may be provided extending from that edge of the discontinuous portion of the strip which is to be embedded. The slots or slits may be straight or bent or curved, and/or angled in the discontinuous portion of the strip. The slots or slits may be uniform or non-uniform. The slots or slits may extend up to or beyond a level to which the strip is to be embedded.

Alternatively, the discontinuities may comprise holes formed in the discontinuous portion of the strip. Holes of a required shape, such as rectangular, circular or oval, may be provided in the discontinuous portion of the strip, the holes being dimensioned such that they span a substantial part of that depth of the strip which is to be embedded. The holes may extend up to or beyond a level to which the strip is to be embedded.

The strip may be of corrugated (sometimes also known as sinuous or serpentine or convoluted) form along its length.

The strip suitably comprises a metal or a metal alloy, such as, for example, an iron-chromium-aluminium alloy. However the invention is not limited to any particular material or configuration of the strip.

The insulation material may comprise microporous thermal and electrical insulation material.

Suitable microporous thermal and electrical insulation materials are well-known in the art, for example as described in GB-A-1 580 909, a typical composition being:

| | |
|---|---|
| Microporous pyrogenic silica | 49 to 97% by weight |
| Ceramic fibre reinforcement | 0.5 to 20% by weight |
| Opacifier | 2 to 50% by weight |
| Alumina | up to 12% by weight |

The proportion of alumina is preferably in the range from 0.5 to 12 percent by weight.

The invention is now described by way of example with reference to the accompanying drawings in which:

DESCRIPTION OF PREFERRED EMBODIMENTS

Figure 1:
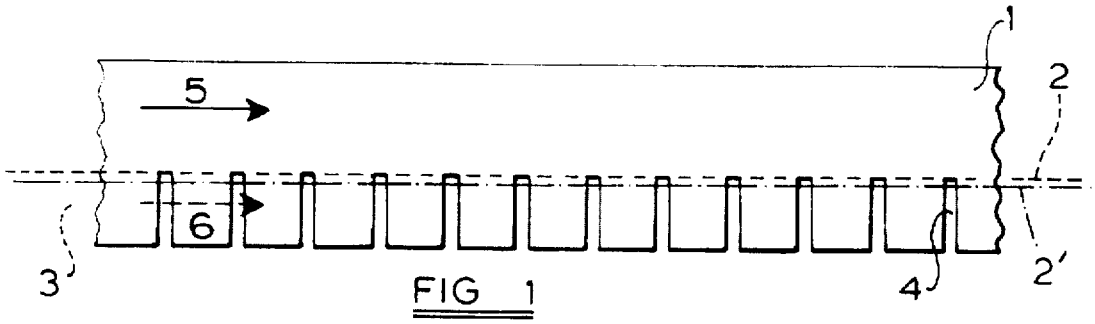
FIG. 1 is a side elevational view of a first embodiment of an electrical heating element according to the present invention.

Referring to FIG. 1, an electrical heating element for a radiant electric heater consists of an elongate electrically conductive strip 1, of a metal or a metal alloy, which is intended to be embedded edgewise, to a level substantially represented by dashed line 2, in a base of electrical and thermal insulation material 3. Such base may, for example, comprise compacted microporous thermal and electrical insulation material such as that described in GB-A-1 580 909.

The strip 1 comprises a continuous portion (the upper portion as illustrated in FIG. 1) and a discontinuous portion (the lower portion as illustrated in FIG. 1). The lower, discontinuous portion is provided with a plurality of discontinuities in the form of spaced-apart slits 4 extending into the strip 1, from the edge thereof and substantially up to the level 2 to which the strip is intended to be embedded if the strip 1 is to be embedded to the top of the slits 4 or up to the level 2' to which the strip is to be embedded if the strip 1 is to be embedded to a level below the top of the slits 4. The slits 4 should ideally be disposed as close together as is reasonably possible. As illustrated in FIG. 1, the slits 4 occupy a minor proportion of the area of the discontinuous portion of the strip 1.

If the strip when embedded is connected at its ends to a suitable voltage source, for operation is a heating element in a radiant heater, electric current will flow through the exposed, that is unembedded, continuous portion of the strip 1 as shown by the arrow 5, resulting in the desired heating of the strip in this region to fulfil its function as a heating element. In the at least partially embedded discontinuous portion of the strip, however, because of the presence of the slits 4, little or no electric current can flow along where indicated by the arrow 6. This means that substantially no electrical heating of the discontinuous portion of the strip 1 occurs. Consequently, the temperature attained by the strip in the discontinuous portion is very much lower than that attained by the strip in the continuous portion. This is advantageous in that it prevents undesirable high temperatures being attained in the region of the insulation material.

The arrangements shown in FIG. 2 to 7 operate in a similar manner to the arrangement of FIG. 1.

Figure 2:
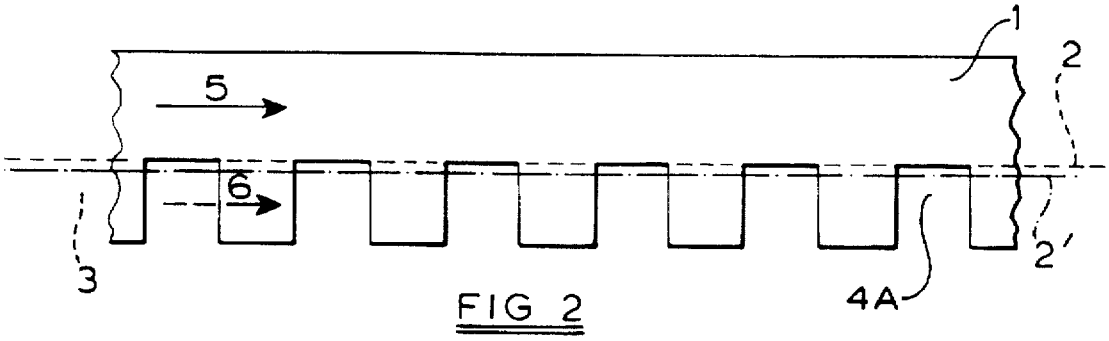
FIG. 2 is a side elevational view of a second embodiment of an electrical heating element according to the present invention.

In FIG. 2, instead of the slits 4 of FIG. 1, slots 4A are provided, likewise disposed relatively close together and extending into the discontinuous portion of the strip 1 from the edge thereof and substantially up to the level 2 or 2' to which the strip 1 is intended to be embedded in the insulation 3. As illustrated in FIG. 2, the slits 4A occupy only about half the area of the discontinuous portion of the strip 1.

Figure 3:
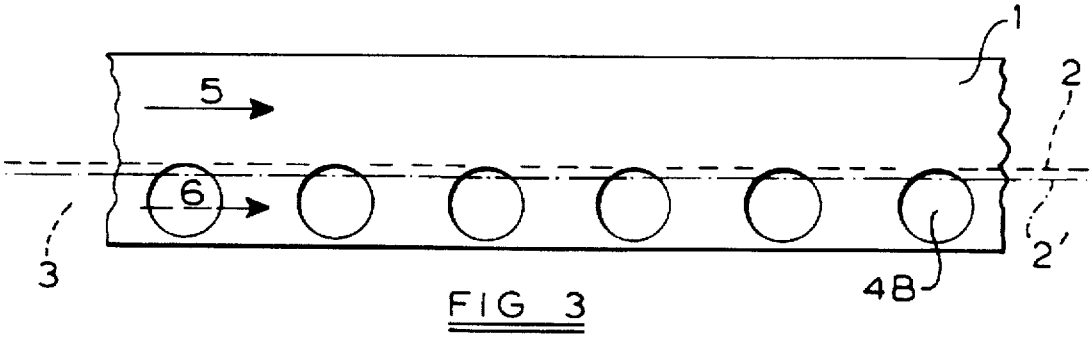
FIG. 3 is a side elevational view of a third embodiment of an electrical heating element according to the present invention.
Figure 4:
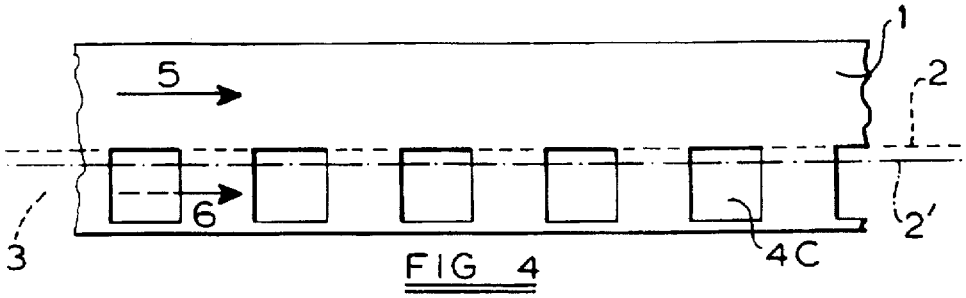
FIG. 4 is a side elevational view of a fourth embodiment of an electrical heating element according to the present invention.

In FIGS. 3 and 4, rows of circular holes 4B and square holes 4C respectively are provided which are dimensioned such that they span as much as possible of the distance between the edge of the strip which is to be embedded and the level 2 or 2' to which it is to be embedded. The slots 4A in FIG. 2 and the holes 4B and 4C in FIGS. 3 and 4 fulfil the same role as described for the slits 4 in FIG. 1, namely in minimizing flow of electric current along the strip 1 in the embedded region thereof when the strip is operating as a heating element.

Figure 5:
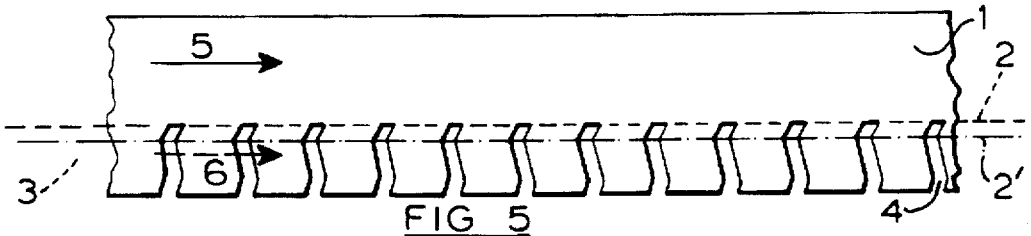
FIG. 5 is a side elevational view of a fifth embodiment of an electrical heating element according to the present invention.
Figure 6:
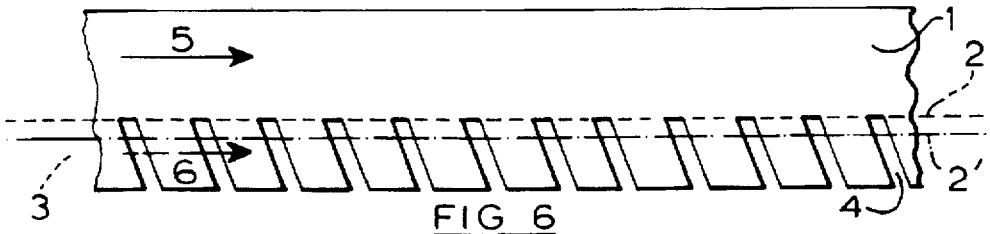
FIG. 6 is a side elevational view of a sixth embodiment of an electrical heating element according to the present invention.
Figure 7:
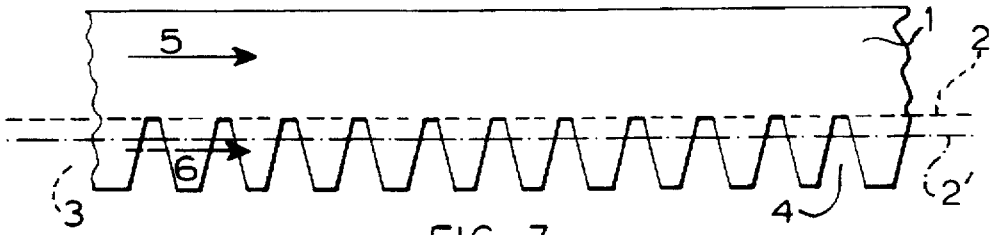
FIG. 7 is a side elevational view of a seventh embodiment of an electrical heating element according to the present invention.

In FIG. 5, the slits 4 are bent or curved, in FIG. 6, the slits 4 are angled, and in FIG. 7 the slits 4 are non-uniform along their length.

If desired, the slits 4, slots 4A and holes 4B, 4C may be arranged so that they extend beyond the level to which the strip is to be embedded in the insulation material 3 as shown by the level 2'. With such an arrangement, the slits 4, slots 4A and holes 4B, 4C will be partially exposed when the strip 1 is embedded in the insulation material 3.

The slits 4, slots 4A and holes 4B, 4C fulfil a further function in that when the strip 1 is embedded, for example by pressing edgewise into the insulation material 3, insulation material enters the slits, slots or holes and this assists in securing the strip 1 in its embedment in the insulation material 3. This is particularly advantageous when the insulation material is microporous insulation material. I have found that microporous thermal insulation material, even when compacted into a metal dish, retains a certain amount of resilience and this assists in retaining the strip 1 in the base due to friction.

Further advantages resulting from the use of the slits, slots or holes are as follows. They reduce the mass of the strip 1 and this leads to more rapid heating up of the continuous portion of the strip to a radiant operating temperature. Such rapid heating up to radiance is also enhanced by the slots, slits or holes serving as a means to reduce thermal conduction from the continuous portion of the strip into the discontinuous portion which is embedded. In this latter regard, it may be advantageous to provide slots or slits which are bent or curved or angled with respect to one another in the strip.

The strip 1 may, if desired, be provided of corrugated form along its length.

Figure 8:
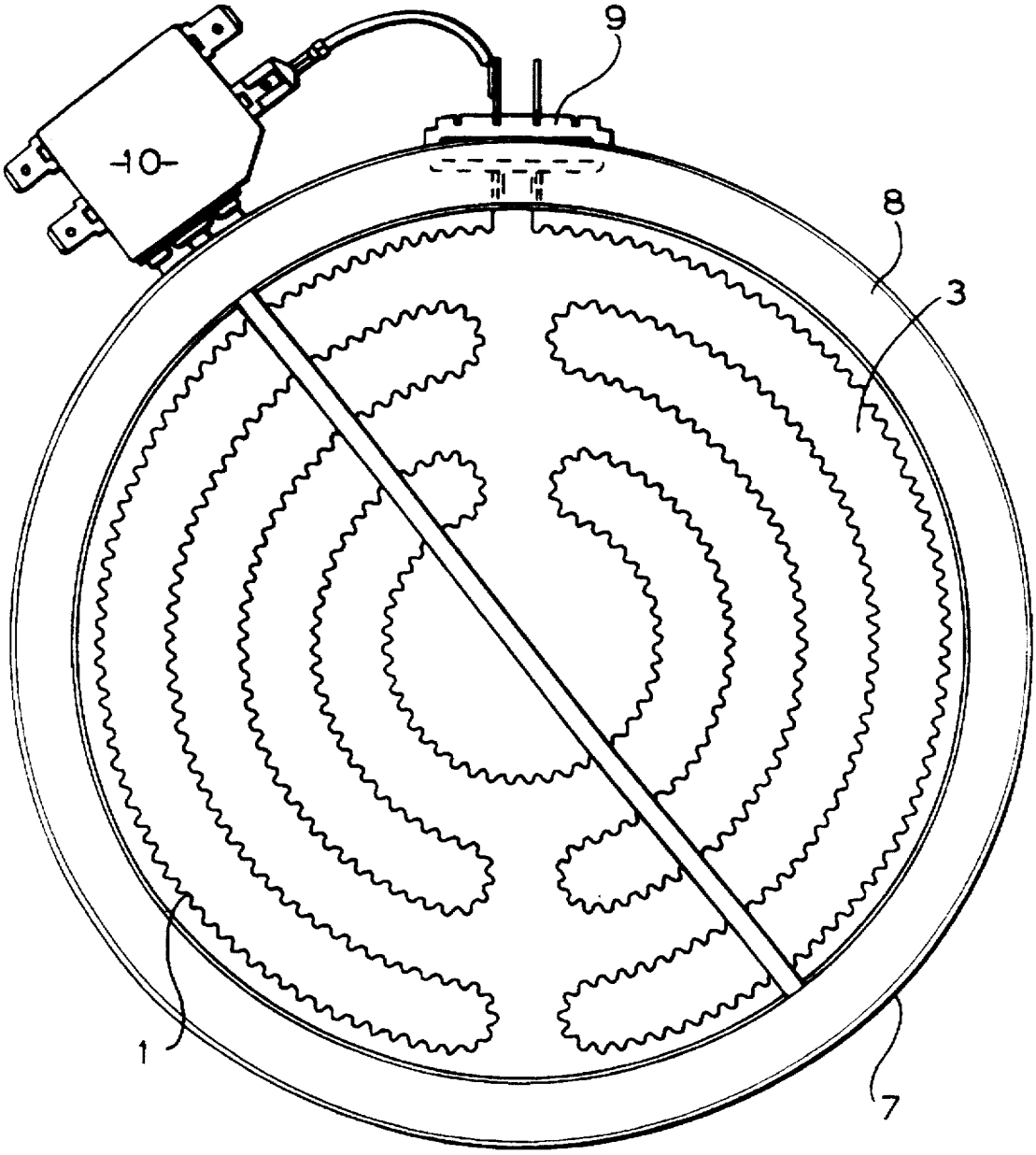
FIG. 8 is a plan view of a radiant electric heater incorporating an electrical heating element according to the present invention.

FIG. 8 illustrates an application of a heating element according to the present invention to a radiant electric heater for use under a glass-ceramic plate of a smooth top cooker. A heating element comprising an elongate electrically conductive strip 1 of a metal or a metal alloy, such as an iron-chromium-aluminium alloy, constructed as shown in any one of FIGS. 1 to 7 and described above with reference thereto, is made into corrugated form and partially embedded by pressing edgewise into the surface of a base layer 3 of microporous thermal and electrical insulation material, such as that described in GB-A-1 580 909, compacted into a metal dish 7. After embedding, the surface of the base layer 3 is arranged to be substantially at the level 2 or 2' shown in FIGS. 1 to 7. Against the side of the dish 7 is located a peripheral wall 8 of thermal insulation material such as ceramic fibre material or microporous insulation material. A terminal connector 9 is provided for electrically connecting the heating element strip 1 to an electrical supply.

A well-known form of thermal cut-out device 10 is provided extending over the heating element 1 to switch off the heating element in the event of over-heating of the glass-ceramic cooking surface when the heater is installed and operating in a cooker provided with such a glass-ceramic cooking surface.

I claim:

1. A method of manufacturing a radiant electric heater comprising:

providing a base of compacted microporous thermal and electrical insulation material;

providing a heating element in the form of an elongate electrically conductive strip, the strip being of uniform thickness and composed of an elongate continuous portion and an elongate discontinuous portion integral and coplanar with the continuous portion, the discontinuous portion being provided with a plurality of discontinuities therein such that in operation of the heater current flow in the discontinuous portion is reduced or eliminated; and pressing the heating element edgewise into the base so as to at least partially embed the discontinuous portion of the heating element in the base with the insulation material entering the discontinuities to thereby enhance securement of the heating element to the base.

2. A method according to claim 1, wherein discontinuities are provided extending from the leading edge of the strip, which is embedded.

3. A method according to claim 1, wherein the area of the discontinuities of the discontinuous portion is less than the remainder of the area of the discontinuous portion.

4. A method according to claim 3, wherein the discontinuities comprise slits the discontinuous portion of the strip.

5. A method according to claim 1, wherein the discontinuities are in spaced relationship along the length of the discontinuous portion of the strip.

6. A method according to claim 1, wherein the discontinuities are straight in the discontinuous portion of the strip.

7. A method according to claim 1, wherein the discontinuities are curved in the discontinuous portion of the strip.

8. A method according to claim 1, wherein the discontinuities are angled in the discontinuous portion of the strip.

9. A method according to claim 1, wherein the discontinuities are uniform.

10. A method according to claim 1, wherein the discontinuities are non-uniform.

11. A method according to claim 1, wherein the discontinuities extend at least up to a level to which the strip is embedded.

12. A method according to claim 2 wherein the area of the discontinuities of the discontinuous portion is substantially equal to the remainder of the area of the discontinuous portion.

13. A method according to claim 1, wherein the discontinuities comprise slots the discontinuous portion of the strip.

14. A method according to claim 1, wherein the discontinuities comprise holes formed in the discontinuous portion of the strip.

15. A method according to claim 14, wherein the holes are dimensioned such that they span a substantial part of that depth of the strip which is embedded.

16. A method according to claim 15, wherein the holes extend at least up to a level to which the strip is embedded.

17. A method according to claim 1, wherein the strip is of corrugated form along its length.

18. A method according to claim 1, wherein the material of the strip is selected from the group consisting of a metal and a metal alloy.

* * * * *

UNITED STATES PATENT AND TRADEMARK OFFICE

CERTIFICATE OF CORRECTION

PATENT NO. : 5,699,606

DATED : December 23, 1997

INVENTOR(S) : Joseph Anthony McWilliams

It is certified that error appears in the above-indentified patent and that said Letters Patent is hereby corrected as shown below:

Claim 1, column 6, line 50, insert after the word "base" -- , --

Claim 2, column 6, line 53, insert after the word "wherein" -- the --;

Claim 4, column 6, line 60, and Claim 13, column 7, line 15 and 16, delete the phrase "the discontinuous portion of the strip."

Claims 3 and 5 through 11, first line of each, delete the numeral "1" and substitute therefor -- 2 --.

Claim 13, first line, delete the numeral "1" and substitute therefor -- 12 --.

Signed and Sealed this

Twenty-fourth Day of March, 1998

*Attest:*

Bruce Lehman

BRUCE LEHMAN

*Attesting Officer*

*Commissioner of Patents and Trademarks*